US007421970B2

(12) United States Patent
Levesque

(10) Patent No.: US 7,421,970 B2
(45) Date of Patent: Sep. 9, 2008

(54) ACCESS DEVICES FOR INFLATABLE AND OTHER BOATS

(75) Inventor: Paul Levesque, Delta (CA)

(73) Assignee: Zodiac Hurricane Technologies, Inc. (CA)

( * ) Notice: Subject to any disclaimer, the term of this patent is extended or adjusted under 35 U.S.C. 154(b) by 0 days.

(21) Appl. No.: 11/327,622

(22) Filed: Jan. 6, 2006

(65) Prior Publication Data

US 2006/0185574 A1 Aug. 24, 2006

Related U.S. Application Data

(60) Provisional application No. 60/642,615, filed on Jan. 10, 2005.

(51) Int. Cl.
*B63B 17/00* (2006.01)

(52) U.S. Cl. ..... 114/362; 114/343; 441/39

(58) Field of Classification Search ..... 114/343, 114/345, 362; 441/39, 40
See application file for complete search history.

(56) References Cited

U.S. PATENT DOCUMENTS 5,537,949 A * 7/1996 Blevins et al. ..... 114/362
5,579,714 A 12/1996 Hemphill
5,832,864 A 11/1998 Hemphill
5,878,685 A 3/1999 Hemphill et al.
5,915,328 A * 6/1999 Rowan ..... 114/362
6,182,598 B1 2/2001 Bozzo
6,371,040 B1 4/2002 Hemphill et al.
7,004,101 B1 2/2006 Mardikian et al.
2004/0103839 A1 6/2004 Fleming

OTHER PUBLICATIONS

International Search Report in related International Application No. PCT/IB2006/000013.

* cited by examiner

*Primary Examiner*—Lars A Olson
(74) *Attorney, Agent, or Firm*—Dean W. Russell; Kilpatrick Stockton LLP

(57) ABSTRACT

Equipment for entering and exiting boats is addressed. Generally, the equipment is in the form of "divers' doors" for inflatable or similar boats. However, unlike existing inflatable doors, the doors discussed herein need not necessarily inflate. Instead, they may be formed as flaps moveable between closed and open positions. Ramped rub strakes or other aspects of the boats may assist in diverting water away from any gaps present when the flaps are closed but the boats are travelling at significant speeds.

26 Claims, 5 Drawing Sheets

ACCESS DEVICES FOR INFLATABLE AND OTHER BOATS

CROSS REFERENCE TO RELATED APPLICATION

This application claims priority to U.S. Provisional Application No. 60/642,615 filed Jan. 10, 2005, the contents of which are incorporated herein by reference.

FIELD OF THE INVENTION

This invention relates principally to devices providing access to inflatable and other boats and exits therefrom and more particularly, but not exclusively, to "divers' (or diver's) doors" for such boats.

BACKGROUND OF THE INVENTION

Commonly-owned U.S. Pat. No. 5,579,714 to Hemphill (the "Hemphill '714 Patent") illustrates an exemplary divers' door for an inflatable or other boat. As disclosed in the Hemphill '714 Patent:

> The diver's door includes a removable support section including a device for releasably attaching the support section to the deck of a boat and a corresponding removable tube element attached to the removable support section to form a single unit removable from the deck of a boat.

See Hemphill '714 Patent, Abstract, 11. 4-9. To effect removal of the door from the boat for ingress or egress, the removable tube element is at least partially deflated to allow disengagement of the end cap of the removable element from a hoop flange. After the end cap is disengaged, the removable element may be grasped and removed from its position, thus creating an opening in the inflatable boat. See id., col. 4, 11. 34-38 and 46-53.

Commonly-owned U.S. Pat. No. 5,832,864 to Hemphill (the "Hemphill '864 Patent") details another divers' door for inflatable and similar boats. Like that of the Hemphill '714 Patent, the door of the Hemphill '864 Patent includes a removable inflatable element normally fitted between tubes of an inflatable boat. Likewise, removal of the element is effected by deflating it (at least partially). Both the Hemphill '714 Patent and the Hemphill '864 Patent are incorporated herein in their entireties by this reference.

SUMMARY OF THE INVENTION

The present invention provides alternatives to the divers' doors of these patents and other such doors in current commercial use. Unlike existing doors incorporating an inflatable element, those of the present invention may, but need not, do so. Instead, they may comprise one or more flaps of material moveable between "closed" and "open" positions.

When closed, the flap bridges space between inflatable or foam-filled tubes of a boat. Preferably, the flap is flexible, so that it may assume when closed a shape similar to that of the exterior of the tubes. By contrast, when the flap is open, it exposes the access space to the boat; further, it may be positioned in the water and available to be grasped by a diver seeking to enter the boat. In at least this manner, an open flap may function as an interface between the boat and the water on which the boat floats.

The configuration and structure of the flap additionally permits its being deployed even when the boat is moving (albeit at relatively slow speeds). However, at higher speeds the flap generally will be closed, so as not adversely to affect performance of the boat. Because wind forces may tend to create gaps between the flap and the inflatable tubes or hull of the boat (especially if the flap is positioned to the outside of the tubes), it may be beneficial to reduce the likelihood of water entering the boat via such gaps.

The present invention accordingly also includes means for diverting water away from, especially, the leading edge of the flap. In particular, rub strakes associated with the flap and tubes may effect such diversion. Strakes on the tubes immediately forward of the flap may, for example, be ramped so as to deflect water away from the leading edge of the flap. The ramped strakes preferably will be made of a flexible extrusion (e.g. Hypalon) covered by fabric, although other materials and configurations may be utilized instead. Alternatively or additionally, the flap may be positioned predominantly to the inside of the tubes.

Versions of the present invention may include one or more straps (or similar objects) to cinch the flap tightly to the remainder of the boat when the flap is closed. These straps conceivably may be permanently formed with or attached to the flap itself Alternatively, they may be permanently attached to some other portion of the boat and connected only temporarily to the flap for closure. This latter structure has the advantage of avoiding the straps entering the water when the flap is deployed, thereby reducing the possibility of the straps snagging on debris or other things in the water. In either circumstance, hooks, levers, or similar equipment additionally may be employed to effect cinching of the flap.

Additionally optionally included as part of the invention may be a bar or handle formed with or connected to the flap. If positioned near the distal end of the flap when deployed, the bar may function in some respects as a step for a diver desiring to exit the water and enter the boat. It further may function as part of the closure and cinching system when the flap is closed.

Because positioned away from the boat in this configuration, the bar also may be grasped easily by someone in the water. Together with optional life lines positioned on the boat forward and aft of the flap, the bar may facilitate efforts to rescue persons in the water. Boats consistent with the invention further may, if desired, include handles positioned on their decks adjacent the flaps, in some cases allowing divers to re-enter the boats unassisted.

Some existing boats lack self-draining decks. Consequently, opening a flap in these boats could permit water to enter and remain in the boats. To reduce this possibility, the invention also includes systems and techniques for raising, temporarily or permanently, decks in the area of the flaps so the decks are no lower than the ambient waterline.

Additional embodiments of the invention may retain buoyant tube structure in the vicinity of the flap. The tube structure may, however, have a lower profile (i.e. decreased height) as compared to adjacent tube sections. Nevertheless, retaining some tube structure in the area of the divers' door avoids reduced buoyancy and rigidity issues associated with having removable tube elements. Alternatively, a rigid spacer may be placed in the door area. Yet alternatively or additionally, the flap itself may have an inflatable portion.

It thus is an optional, non-exclusive object of the present invention to provide so-called "divers' doors" for boats, particularly (although not exclusively) ones utilizing inflatable bladders or buoyant foam for flotation.

It is another optional, non-exclusive object of the present invention to provide doors that themselves need not be inflatable.

It is a further optional, non-exclusive object of the present invention to provide doors comprising one or more flaps of material moveable between closed and open positions.

It is also an optional, non-exclusive object of the present invention to provide means for diverting water away from the flap (and particularly its leading edge) when the flap is closed and the boat is moving.

It is, moreover, an optional, non-exclusive object of the present invention to provide diverting means in the form of ramped rub strakes or flanges on tubes immediate adjacent the leading edges of the flaps.

It is yet another optional, non-exclusive object of the present invention to provide equipment for cinching flaps closed when not needed as divers' doors.

It is, furthermore, an optional, non-exclusive object of the present invention to provide one or more steps associated with the flap, one such step conceivably being a bar or handle positioned at or adjacent an end of the flap distal from the boat when deployed.

It is an additional optional, non-exclusive object of the present invention to provide systems and techniques for raising, temporarily or permanently, the levels of boat decks to reduce ingress of water when flaps are open.

Other objects, features, and advantages of the present invention will be apparent to those skilled in the relevant art with reference to the remaining text and the drawings of this application.

DETAILED DESCRIPTION

Figure 1:
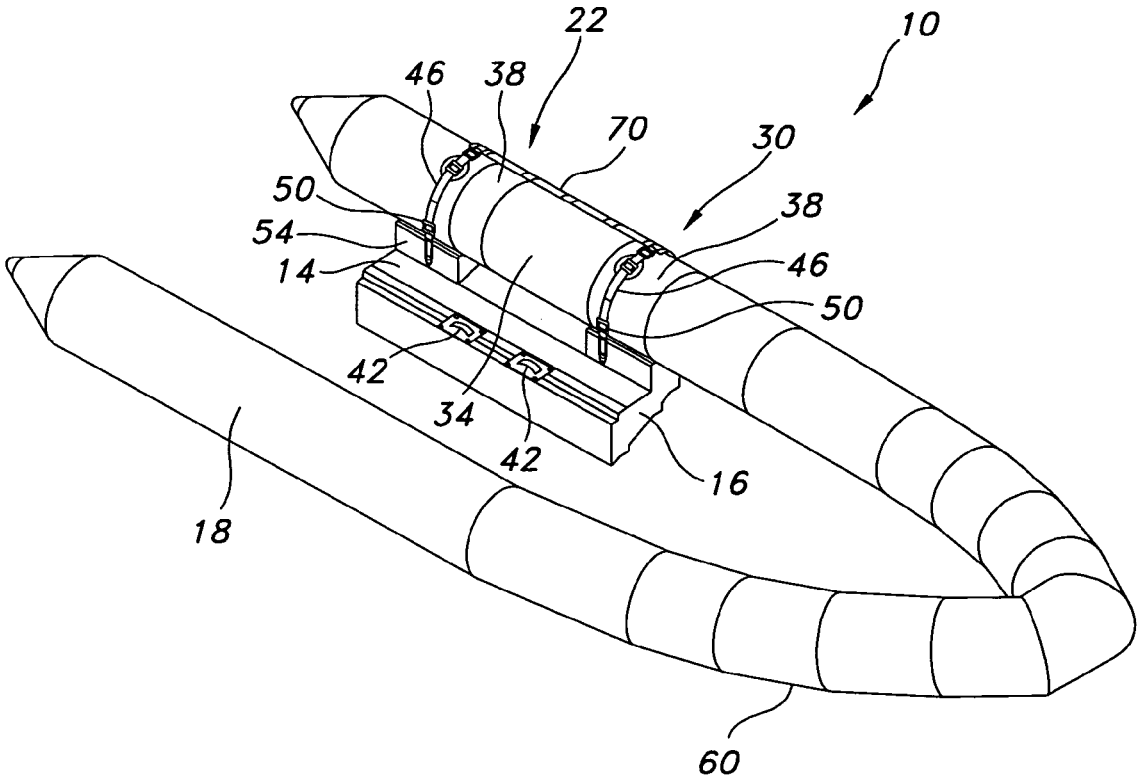
FIGS. 1-2 are cut-away views showing portions of the deck, tubes, and undeployed divers' door of an exemplary inflatable or similar boat of the present invention.
Figure 2:
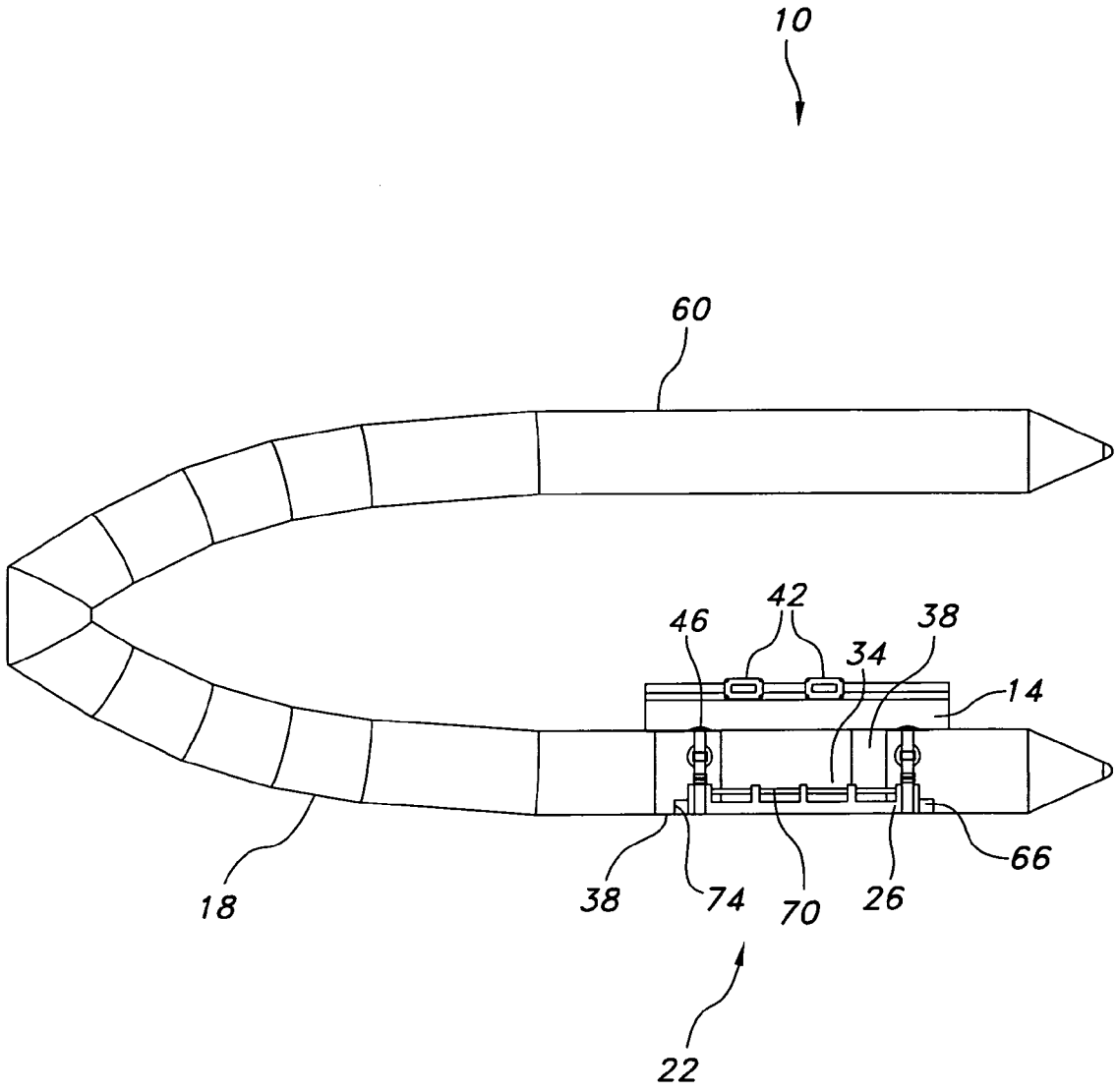

Depicted in FIGS. 1-2 are aspects of an exemplary boat 10 of the present invention. Boat 10 may (but need not) be similar to the inflatable boats shown in FIG. 1 of each of the Hemphill '714 Patent and the Hemphill '864 Patent. Accordingly, boat 10 may, for example, include deck 14, hull 16, and one or more tubes 18 attached thereto. In some versions of boat 10, tubes 18 are inflatable for flotation; in other versions, tubes 18 may include buoyant foam. Yet other versions of tubes 18 may include both foam and inflatable materials, while other boats 10 may lack tubes 18 entirely. Further, although tubes 18 preferably are tubular in shape, they may be configured otherwise as necessary or desired.

Also illustrated in FIGS. 1-2 is access assembly 22 of boat 10. Assembly 22 comprises at least flap 26 and means 30 for connecting flap 26 directly or indirectly to any of deck 14, hull 16, or tubes 18. Assembly 22 also may, if desired, comprise removable section 34 and one or more hoops 38. Section 34, if present, may be an inflatable or foam-filled tube element preferably, although not necessarily, formed of materials similar or identical to that of tubes 18. Hoops 38, if present, beneficially have substantial rigidity and preferably, although again not necessarily, may be made of polyurethane, fabric, or a combination of the two materials.

Hoops 38 may be employed to facilitate fitting of removable section 34 in-line with tubes 18. They thus are similar to the hoop flanges discussed in the Hemphill '714 Patent and the Hemphill '864 patent, providing structural stability to the exterior contour of boat 10 and reducing the likelihood of water entering boat 10 when section 34 is in place. Any of these optional hoops 38 may be connected to either tubes 18 or removable section 34.

Shown as well in FIGS. 1-2 are one or more handles 42. Such handles 42 may protrude from, be flush with, or otherwise be associated with deck 14 of boat 10. When flap 26 is deployed and deck 14 is made accessible to persons in the water, the persons may grasp handles 42 to facilitate their entering boat 10 from the water.

Additionally shown in FIG. 1-2 are straps 46 and connectors 50 of connecting means 30. In the version of boat 10 illustrated in these figures, straps 46 connect flap 26 to portion 54 of either deck 14 or hull 16. Connectors 50 are designed to permit cinching of straps 46, causing flap 26 when closed to assume the shape of the exterior of tubes 18, removable section 34, and hoops 38.

Figure 3:
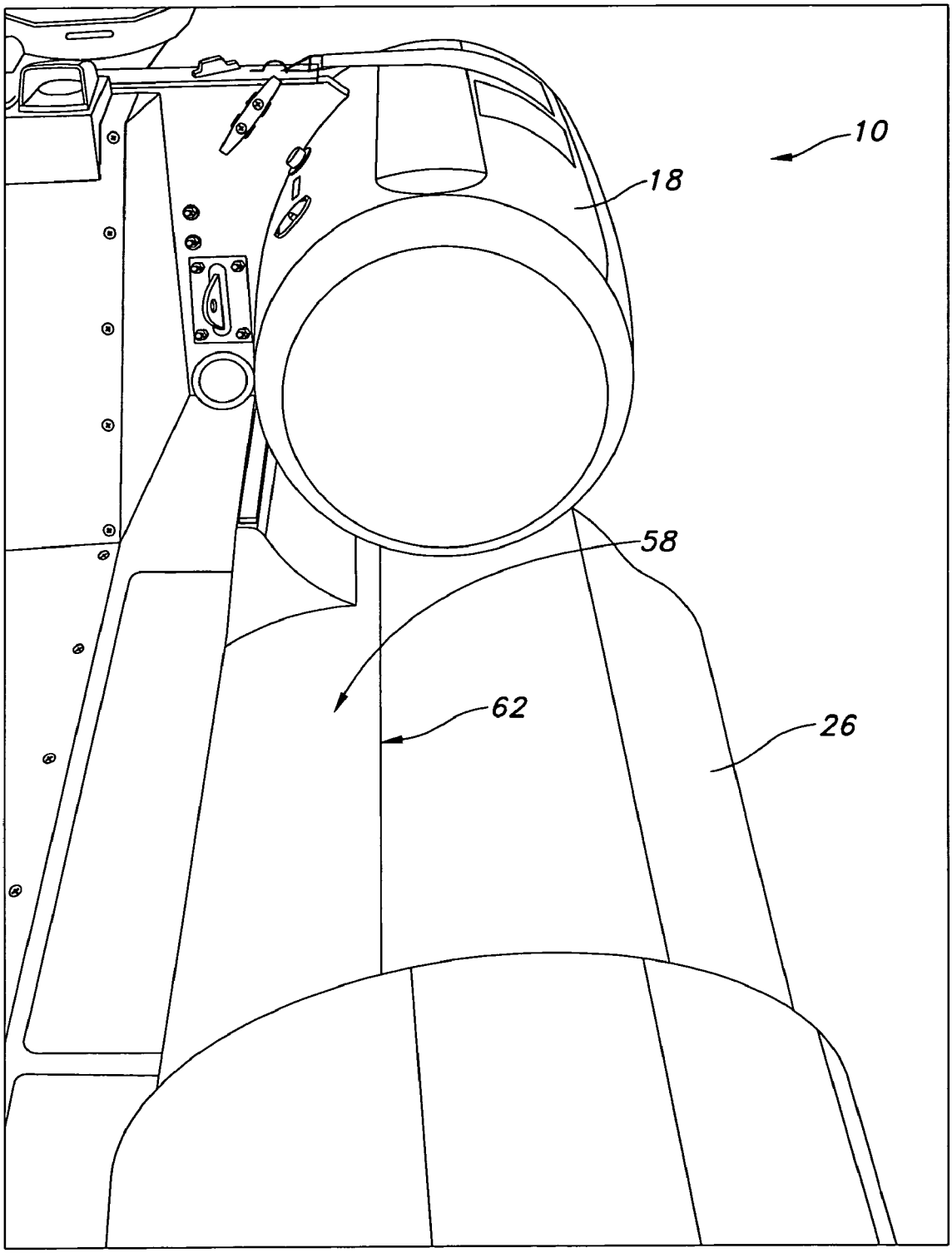
FIG. 3 illustrates portions of a boat consistent with FIG. 1 with the divers' door deployed.

To deploy flap 26, connecting means 30 need merely be disengaged and section 34, if present, removed from its position intermediate tubes 18. These actions result in boat 10 appearing as shown in FIG. 3, with space 58 existing in perimeter or side wall 60 of the boat 10. Entry into and exit from boat 10 thus may be achieved simply by passing through space 58.

Although proximate end 62 of flap 26 must remain connected in some manner to some portion of boat 10, distal end 66 when deployed is designed to enter the water adjacent the boat 10 (as illustrated in FIG. 3). At or adjacent end 66, therefore, bar 70 may be connected to or incorporated into flap 26. Bar 70 hence may function as a step, or easily-graspable handle, for divers or other persons in the water. (Additionally if desired, bar 70 may operate as part of connecting means 30 to which straps 46 are or may be connected.)

Because flap 26 is moveable, risk exists that it may tend to separate from perimeter 60 of boat 10 and allow water to enter boat 10 (or accumulate between flap 26 and section 34) even when the flap 26 is closed. This tendency may be exacerbated when boat 10 travels at high speed, as leading edge 74 of flap 26 could be subjected to substantial air currents caused by the movement of the boat 10. Tubes 18 thus may be provided with means for diverting air and water away from leading edge 74 when boat 10 is travelling forward.

Figure 4:
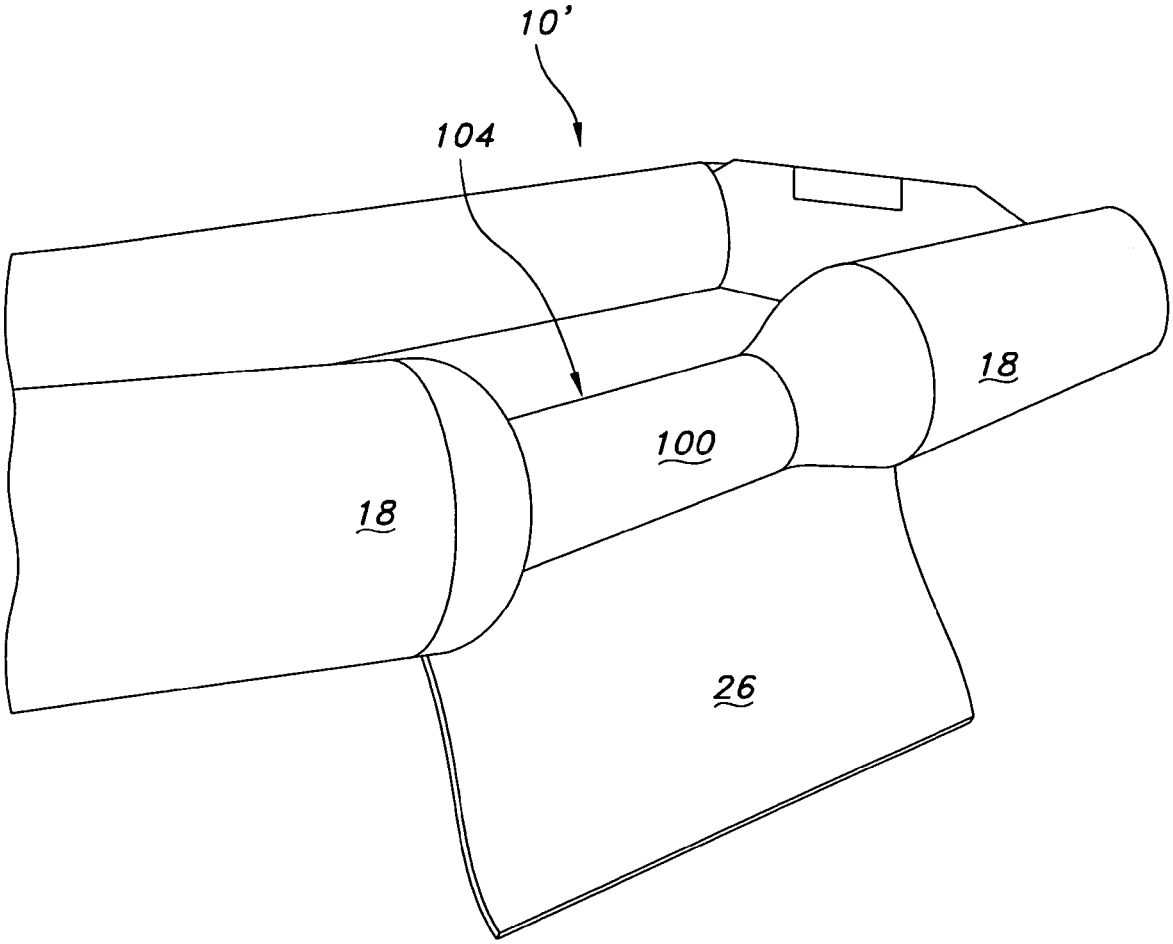
FIG. 4 details an alternate design of a boat in which some tubular structure is retained in the area of the divers' door.

FIG. 4 illustrates an alternate boat 10' of the present invention. Like boat 10, boat 10' may include a deck and a hull as well as one or more tubes 18 and flaps 26. However, rather than having a removable section 34 to create a gap for a divers' door, boat 10' does so by utilizing section 100 of tube 18. Like section 34, section 100 may be an inflatable or foam-filled tube element. Unlike section 34, though, section 100 may be permanently connected to or formed as part of tube 18 and of decreased height so as to create the divers' door or opening 104 when flap 26 is open.

Figure 5:
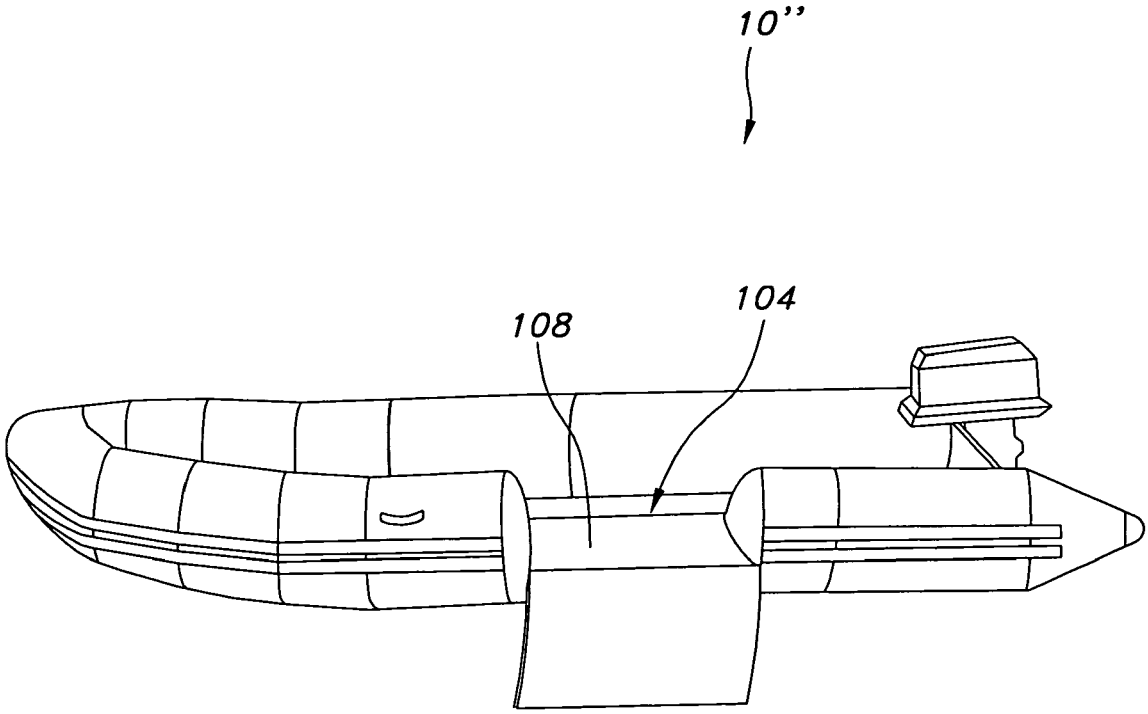
FIG. 5 depicts another alternate boat design in which a rigid spacer is deployed in the area of the divers' door.

Another alternate boat 10" is depicted in FIG. 5. Boat 10" includes spacer 108 in opening 104. Spacer 108 preferably is made of rigid material (e.g. fiberglass) and shaped to fit snugly between portions of tube 18 so as to provide enhanced rigidity in the area of opening 104.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. A boat comprising:

a. a hull;

b. a deck;

c. a side wall defined at least in part by buoyant material, such buoyant material having a gap therein;

d. a door spanning at least part of the gap and comprising a flexible flap connected directly or indirectly to at least one of the hull, deck, or buoyant material; and e. a rigid spacer positioned in the gap.

2. A boat according to claim 1 in which the flap is moveable between a closed position in which it spans at least part of the gap and an open position in which it does not span any of the gap.

3. A boat according to claim 2 in which, when in the open position, the flap extends into water in which the boat floats.

4. A boat according to claim 3 further comprising means, attached to or formed with the flap, for permitting a person in the water to utilize the flap as a step.

5. A boat according to claim 4 in which the step-permitting means comprises a bar.

6. A boat according to claim 1 in which the buoyant material comprises at least one tube containing inflation gas or foam or both inflation gas and foam.

7. A boat comprising:

a. a hull;

b. a deck;

c. a side wall defined at least in part by buoyant material, such buoyant material having a gap therein;

d. a door spanning at least part of the gap and comprising a flexible flap connected directly or indirectly to at least one of the hull, deck, or buoyant material; and e. a tube element fitted into the gap and removable therefrom.

8. A boat according to claim 7 in which the flap is configured to contact the tube element when in the closed position.

9. A boat according to claim 7 further comprising at least one hoop into which the tube element is fitted.

10. A boat according to claim 9 in which the hoop is connected to the side wall.

11. A boat according to claim 7 further comprising means for cinching the flap tightly against the tube element when the tube element is fitted into the gap and the flap is closed.

12. A boat comprising:

a. a hull;

b. a deck;

c. a side wall defined at least in part by buoyant material, such buoyant material having a gap therein;

d. a door spanning at least part of the gap and comprising a flexible flap connected directly or indirectly to at least one of the hull, deck, or buoyant material; and e. means, extending outward from the side wall, for diverting water away from the flap when the boat is moving.

13. A boat according to claim 12 in which the flap has a leading edge, and the diverting means diverts water away from the leading edge, when the boat is moving forward.

14. A boat according to claim 12 in which the diverting means comprises at least one ramped rub strake.

15. A boat comprising:

a. a hull;

b. a deck;

c. a side wall defined at least in part by buoyant material, such buoyant material having a gap therein;

d. a door spanning at least part of the gap and comprising a flexible flap connected directly or indirectly to at least one of the hull, deck, or buoyant material; and e. at least one handle connected to the deck adjacent the gap.

16. A boat comprising:

a. a hull;

b. a deck;

c. a side wall defined at least in part by buoyant material, such buoyant material having a gap therein;

d. a door spanning at least part of the gap and comprising a flexible flap connected directly or indirectly to at least one of the hull, deck, or buoyant material; and e. means for raising the level of the deck relative to the level of water in which the boat floats.

17. A boat comprising:

a. a hull;

b. a deck;

c. a transom; and d. a side wall connected directly or indirectly to at least one of the hull, deck, or transom, the side wall comprising a continuous length of buoyant material forward of the transom and defining first, second, and third sections, the first and third sections having a nominal diameter D in use and the second section (i) existing between the first and third sections and (ii) having a nominal diameter D' in use, where $D'<D$, the second section providing an area for ingress into or egress from the boat.

18. A boat according to claim 17 in which the second section is permanently connected to at least one of the first and third sections.

19. A boat according to claim 17 in which the second section is formed with at least one of the first and third sections.

20. A boat according to claim 17 in which the buoyant material comprises foam.

21. A boat according to claim 17 in which the buoyant material is inflatable.

22. A boat comprising:

a. a hull;

b. a deck;

c. a transom; and d. a side wall connected directly or indirectly to at least one of the hull, deck, or transom, the side wall comprising a continuous length of buoyant material forward of the transom and defining first, second, and third sections, the first and third sections having a nominal height H in use and the second section (i) existing between the first and third sections and (ii) having a nominal height H' in use, where $H'<H$, the second section providing an area for ingress into or egress from the boat.

23. A boat according to claim 22 in which the second section is permanently connected to at least one of the first and third sections.

24. A boat according to claim 22 in which the second section is formed with at least one of the first and third sections.

25. A boat according to claim 22 in which the buoyant material comprises foam.

26. A boat according to claim 22 in which the buoyant material is inflatable.

* * * * *